US011349256B2

(12) United States Patent
Sekino

(10) Patent No.: US 11,349,256 B2
(45) Date of Patent: May 31, 2022

(54) ELECTRICAL CONNECTOR WITH DETECTION MEMBER

(71) Applicant: Yazaki Corporation, Tokyo (JP)

(72) Inventor: Tetsuya Sekino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/211,774

(22) Filed: Mar. 24, 2021

(65) Prior Publication Data

US 2021/0320456 A1 Oct. 14, 2021

(30) Foreign Application Priority Data

Apr. 9, 2020 (JP) ..... JP2020-070129

(51) Int. Cl.

| | |
|---|---|
| ***H01R 13/627*** | (2006.01) |
| ***H01R 13/506*** | (2006.01) |
| ***H01R 13/74*** | (2006.01) |
| ***H01R 13/639*** | (2006.01) |
| ***H01R 13/518*** | (2006.01) |

(52) U.S. Cl.

CPC ..... *H01R 13/6273* (2013.01); *H01R 13/506* (2013.01); *H01R 13/518* (2013.01); *H01R 13/639* (2013.01); *H01R 13/741* (2013.01)

(58) Field of Classification Search

CPC .. H01R 13/506; H01R 13/518; H01R 13/639; H01R 13/741; H01R 13/641; H01R 13/743; H01R 13/516; H01R 13/502; H01R 2201/26

See application file for complete search history.

(56) References Cited

U.S. PATENT DOCUMENTS

| | | | | |
|---|---|---|---|---|
| 5,344,347 | A * | 9/1994 | Inoue | H01R 13/193 439/924.1 |
| 5,913,703 | A * | 6/1999 | Suzuki | H01R 13/641 439/701 |
| 6,179,671 | B1 * | 1/2001 | Ohsumi | H01R 13/4364 439/752 |
| 9,490,574 | B2 * | 11/2016 | Kon | H01R 13/641 |
| 9,502,812 | B2 * | 11/2016 | Akagi | H01R 13/741 |
| 9,525,230 | B2 * | 12/2016 | Zhu | H01R 13/4368 |
| 2016/0118742 | A1 | 4/2016 | Akagi et al. | |

FOREIGN PATENT DOCUMENTS

JP 2016-85897 A 5/2016

* cited by examiner

*Primary Examiner* — Briggitte R. Hammond
(74) *Attorney, Agent, or Firm* — Kenealy Vaidya LLP

(57) ABSTRACT

A connector includes an outer housing, an inner housing fitted to the outer housing, and a detection member assembled to the outer housing and restricted from being separated in a removal direction. The detection member has a flexible lock arm and a member-side protrusion formed on a free end side of the lock arm and facing an outer-side protrusion in the removal direction in an assembled state. When a locking arm gets over the outer-side protrusion and is locked to the outer-side protrusion, the locking arm moves in an insertion direction while being elastically deformed, and elastically returns after getting over the outer-side protrusion to press the member-side protrusion outward an inner housing accommodating space, so that the lock arm allows the outer-side protrusion and the member-side protrusion to be in a non-facing state in the insertion/removal direction, and allows the detection member to be separated in the removal direction.

4 Claims, 11 Drawing Sheets

ELECTRICAL CONNECTOR WITH DETECTION MEMBER

CROSS-REFERENCE TO RELATED APPLICATION(S)

The present application claims priority to and incorporates by reference the entire contents of Japanese Patent Application No. 2020-070129 filed in Japan on Apr. 9, 2020.

BACKGROUND OF THE INVENTION

1. Field of the Invention

The present invention relates to a connector.

2. Description of the Related Art

In the related art, there is a connector having a plurality of housings. Japanese Patent Application Laid-open No. 2016-85897 discloses a connector including a pair of connector housings, a fitting part provided to one connector housing, and a fitted part provided to the other connector housing. In Japanese Patent Application Laid-open No. 2016-85897, the other connector housing (corresponding to an outer housing) has a plurality of movable housings (corresponding to inner housings), and the movable housings are fitted (assembled) to the other connector housing to be temporarily locked.

Incidentally, when the connector has the outer housing and the inner housing, it is desired to easily determine whether the outer housing and the inner housing have been completely fitted.

SUMMARY OF THE INVENTION

The present invention provides a connector capable of easily determining whether an outer housing and an inner housing have been completely fitted.

In order to achieve the above mentioned object, a connector according to one aspect of the present invention includes a tubular outer housing having an outer-side protrusion formed to protrude toward an internal inner housing accommodating space; an inner housing inserted from one opening of the outer housing and accommodated in the inner housing accommodating space, the inner housing having a locking arm that is formed to protrude from an outer peripheral surface of the inner housing, with a fitted state of the inner housing with respect to the outer housing being a completely fitted state, the locking arm getting over the outer-side protrusion, being located on a side of an insertion direction from the outer-side protrusion, and being locked to the outer-side protrusion while facing the outer-side protrusion in a removal direction opposite to the insertion direction; and a detection member that is restricted from being separated from the outer housing in the removal direction opposite to the insertion direction in an assembled state in which the detection member is assembled to the outer housing, wherein the detection member includes: a base that is detachable from the outer housing in an insertion/removal direction; a flexible lock arm that protrudes from the base and extends in the insertion/removal direction; and a member-side protrusion formed on a free end side of the lock arm and facing the outer-side protrusion in the removal direction in the assembled state, and when the locking arm gets over the outer-side protrusion and is locked to the outer-side protrusion, the locking arm moves in the insertion direction while being elastically deformed, and elastically returns after getting over the outer-side protrusion to press the member-side protrusion outward the inner housing accommodating space, so that the lock arm allows the outer-side protrusion and the member-side protrusion to be in a non-facing state in the insertion/removal direction, and allows the detection member to be separated in the removal direction.

According to another aspect of the present invention, in the connector, it is preferable that when the outer housing is viewed from the removal direction, the outer housing has a pair of side portions that face each other in a first direction orthogonal to the insertion/removal direction and extend in a second direction orthogonal to the insertion/removal direction and the first direction, each of the side portions is provided with at least one outer-side protrusion, the locking arm is provided at a position where the locking arm is locked to each of the outer-side protrusions in the completely fitted state, and the detection member is assembled at a position corresponding to each of the outer-side protrusions on the respective side portions in the assembled state.

According to still another aspect of the present invention, in the connector, it is preferable that a part of the outer housing on a side of the removal direction is inserted into a through hole, penetrating from a front surface to a back surface of a wall part in a casing, from a side of the front surface, so that the outer housing is fixed to the front surface, and the inner housing is inserted into the outer housing from a side of the back surface of the wall part via the through hole and is fitted in the insertion direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to an embodiment of the present invention will be described in detail with reference to the drawings. Note that the present invention is not limited to the following embodiment. Furthermore, components in the following embodiment include those that can be easily replaced by a person skilled in the art or those that are substantially the same.

Embodiment

A connector 1 according to the present embodiment will be described with reference to FIG. 1 to FIG. 11. An X direction illustrated in each of FIG. 1 to FIG. 11 (excluding FIG. 5 and FIG. 6) is a first direction of the connector 1 in the present embodiment. The first direction is, for example, a longitudinal direction of the connector 1 when the connector 1 is viewed from a Z direction. A Y direction is a second direction of the connector 1 in the present embodiment. The second direction is, for example, a short direction of the connector 1 when the connector 1 is viewed from the Z direction. The Z direction is an insertion/removal direction of the connector 1 in the present embodiment. In the Z direction, it is assumed that a Z1 direction is the insertion direction and a Z2 direction is the removal direction. The X direction, the Y direction, and the Z direction are orthogonal to one another.

Figure 1:
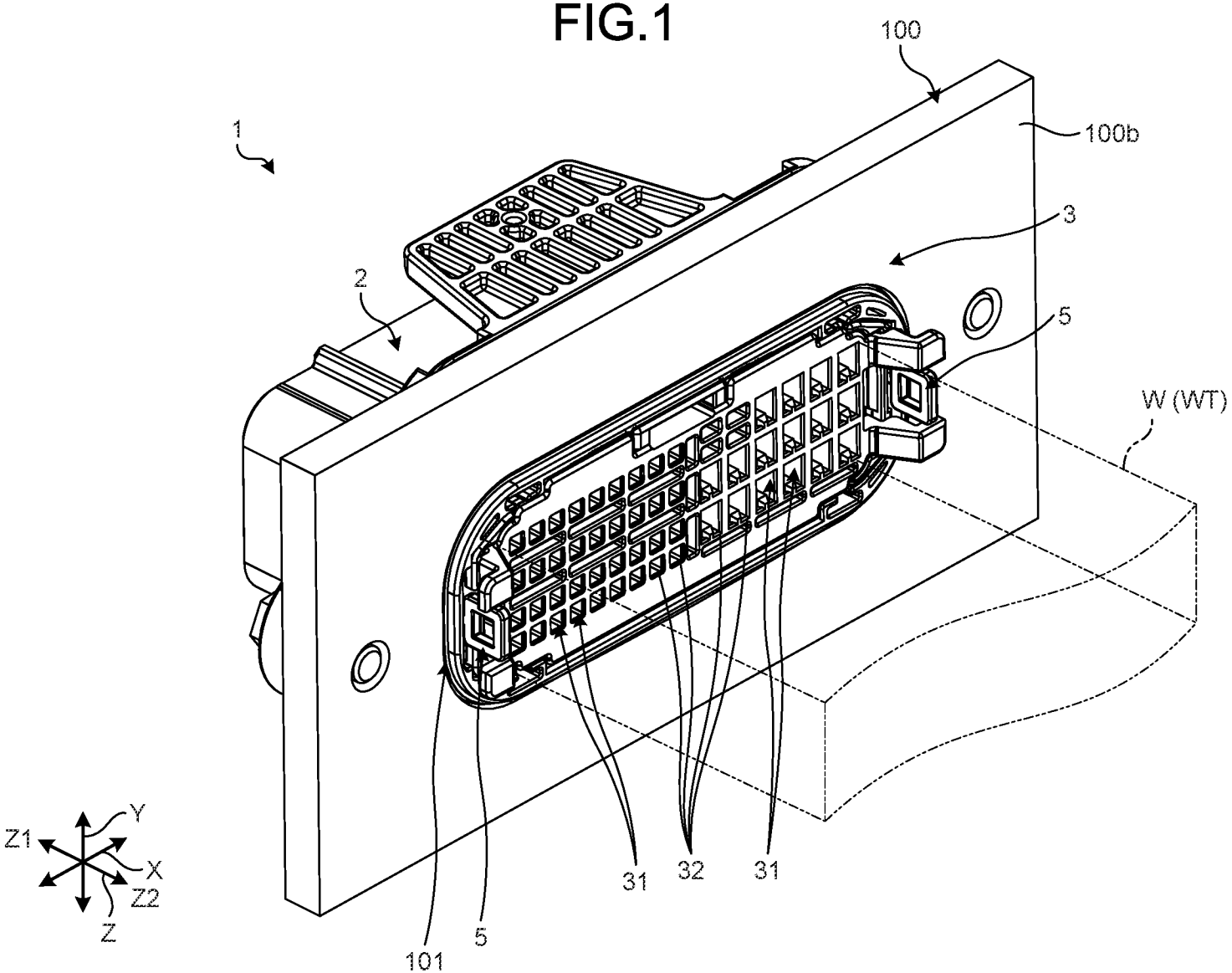
FIG. 1 is a first perspective view of a connector according to an embodiment.
Figure 2:
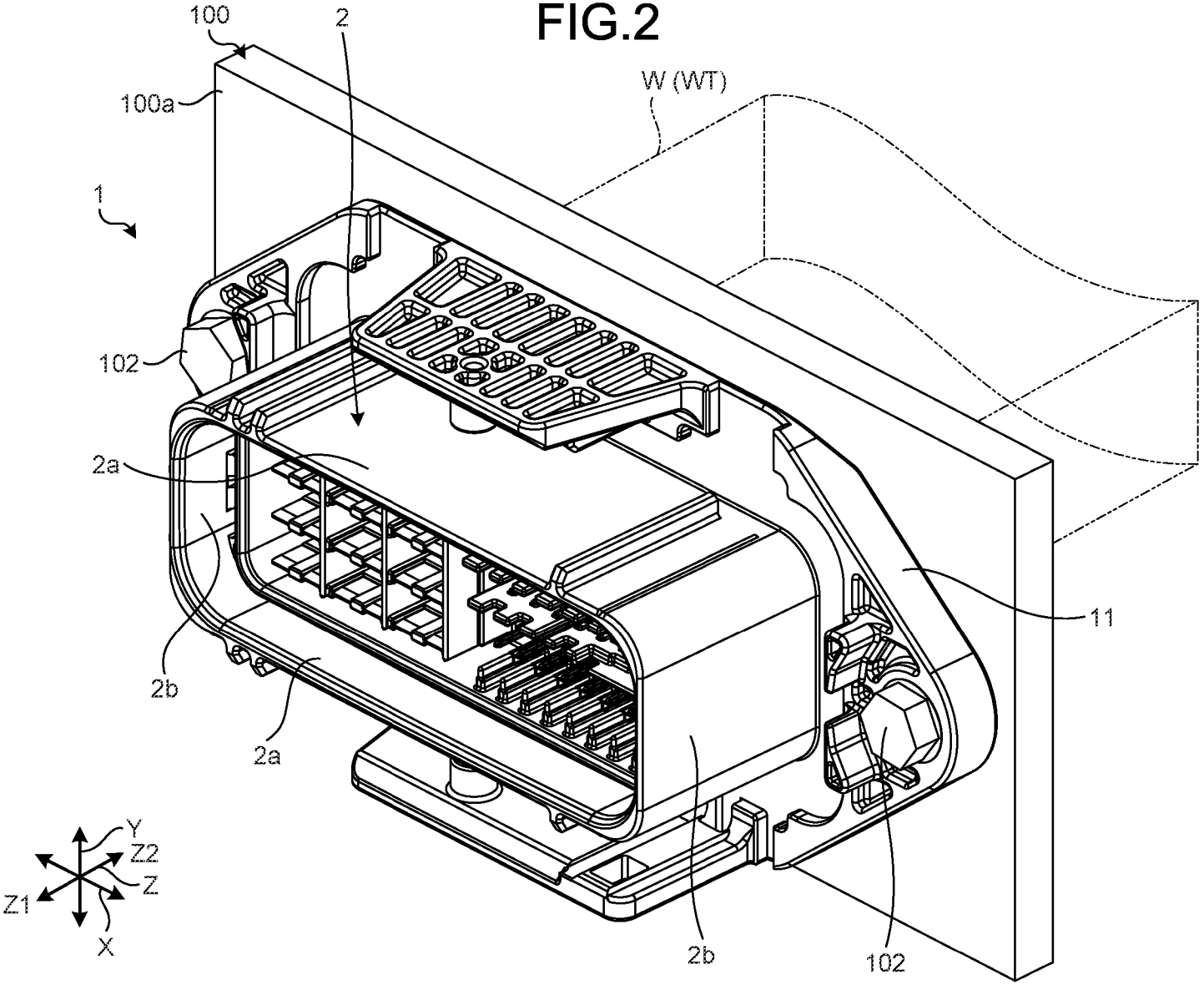
FIG. 2 is a second perspective view of the connector according to the embodiment.
Figure 3:
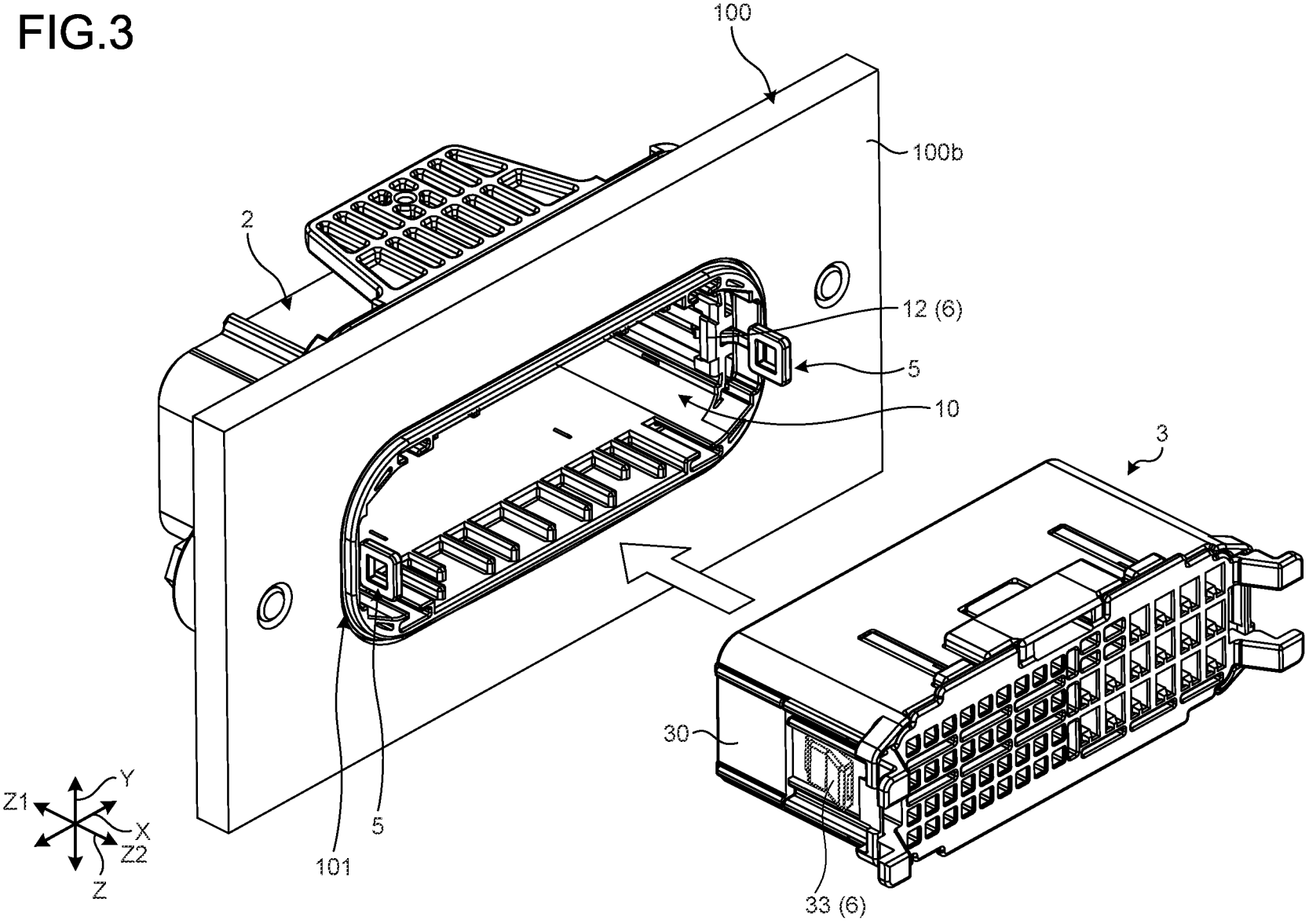
FIG. 3 is a third perspective view of the connector according to the embodiment and is a view illustrating an inner housing inserted into an outer housing.
Figure 4:
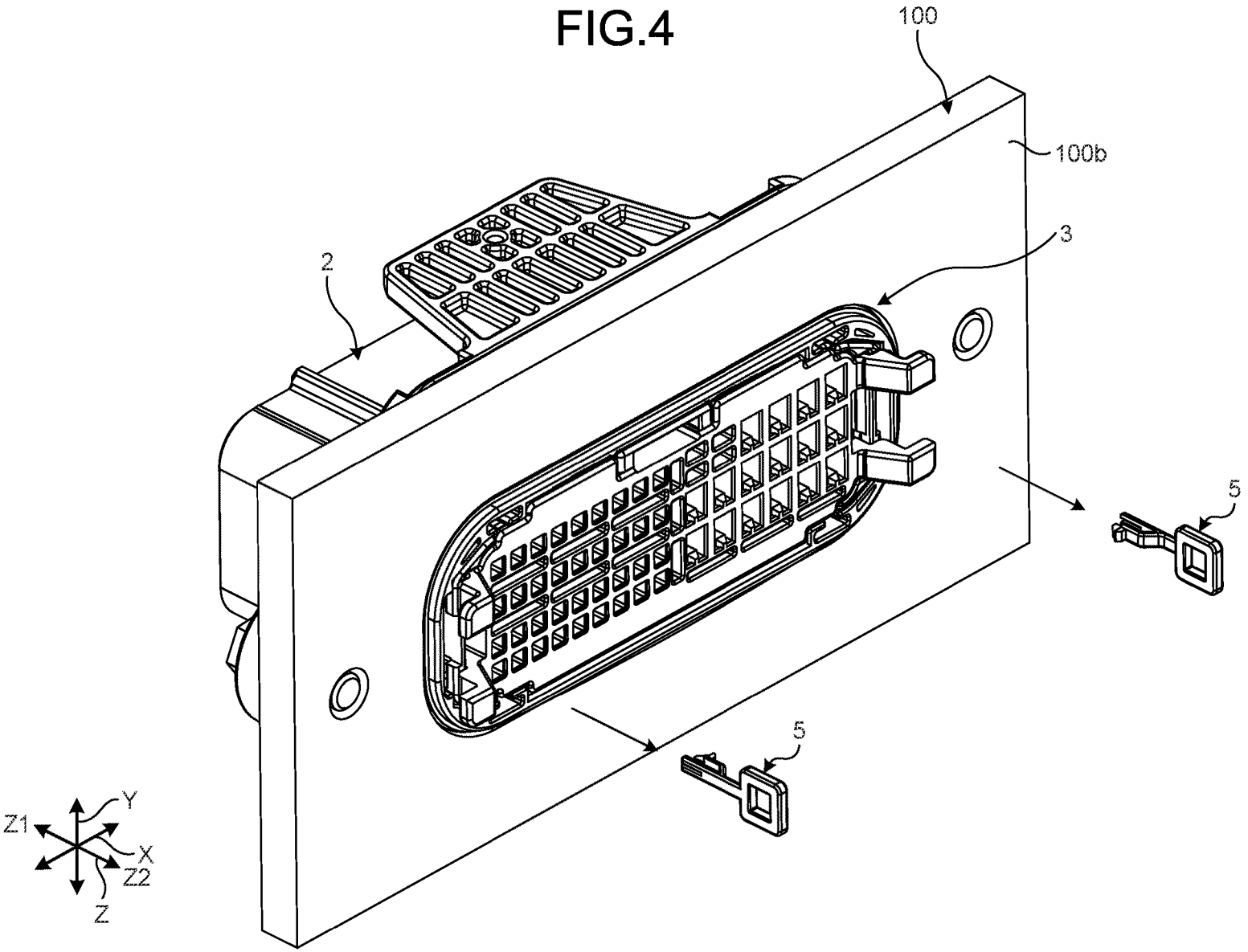
FIG. 4 is a fourth perspective view of the connector according to the embodiment and is a view illustrating a state of the connector from which detection members are separated.

The connector 1 in the present embodiment is applied to, for example, a wire harness and the like used in a vehicle such as an automobile. Here, the connector 1 is a connection mechanism for wire-to-wire connection that connects a plurality of wires W constituting the wire harness. The connector 1 is connected to a mating connector (not illustrated) corresponding to the connector 1. The connector 1 is fixed to a wall part 100 as illustrated in FIG. 1 to FIG. 4. The wall part 100 is, for example, a part of a casing of a device mounted in a vehicle. The wall part 100 may be a wall part constituting a casing of an inverter or a motor. The wall part 100 has a front surface 100*a* and a back surface 100*b*. The front surface 100*a* is, for example, an outer surface of the casing. The back surface 100*b* is, for example, an inner surface of the casing. The wall part 100 has a through hole 101. The through hole 101 penetrates from the front surface 100*a* to the back surface 100*b* of the wall part 100, and is opened on each of the front surface 100*a* and the back surface 100*b*. The sectional shape of the through hole 101 in a section orthogonal to the insertion/removal direction is a rectangle with four corners rounded in an arc shape. The connector 1 of the present embodiment includes an outer housing 2 and an inner housing 3 as illustrated in FIG. 3.

The outer housing 2 is fitted with the inner housing 3 to form the connector 1. A part of the outer housing 2 on the removal direction side is inserted into the through hole 101 of the wall part 100 from the front surface 100*a* side, so that the outer housing 2 is fixed to the front surface 100*a*. The outer housing 2 has a tubular shape in which both ends of the connector 1 in the insertion/removal direction are opened, and accommodates the inner housing 3 in an internal inner housing accommodating space 10 via one of the openings. The outer housing 2 is molded by, for example, an insulating synthetic resin. The sectional shape of the outer housing 2 in a section orthogonal to the insertion/removal direction is a rectangle with four corners rounded in an arc shape.

The outer housing 2 is fixed to the front surface 100*a* of the wall part 100 via a flange portion 11. The flange portion 11 protrudes from an outer surface of the outer housing 2 toward a direction orthogonal to the insertion/removal direction. The flange portion 11 is formed with through holes, into which bolts 102 are inserted, at both ends of the connector 1 in the first direction. The outer housing 2 is fixed to the front surface 100*a* of the wall part 100 by fastening of the bolts 102 inserted into the through holes of the flange portion 11. When the outer housing 2 is viewed from the removal direction side, the outer housing 2 has a pair of long side portions 2*a*, a pair of short side portions 2*b*, a pair of outer-side protrusions 12 (see FIG. 7), and a pair of mounting holes 13 (see FIG. 7).

The pair of long side portions 2*a* are portions extending in the first direction orthogonal to the insertion/removal direction when the outer housing 2 is viewed from the removal direction side. The pair of long side portions 2*a* are formed so as to face each other in the second direction orthogonal to the insertion/removal direction and the first direction. The long side portions 2*a* form a part of a wall part forming the inner housing accommodating space 10.

The pair of short side portions 2*b* are portions extending in the second direction when the outer housing 2 is viewed from the removal direction side. The pair of short side portions 2*b* are formed so as to face each other in the first direction. The length of the short side portion 2*b* is shorter than that of the long side portion 2*a*. The short side portions 2*b* form the other part of the wall part forming the inner housing accommodating space 10.

The pair of outer-side protrusions 12 are provided on an inner surface of the outer housing 2. The pair of outer-side protrusions 12 are formed on the inner surface of the outer housing 2 so as to face each other in the first direction. The outer-side protrusions 12 are provided on the respective short side portions 2*b*. Each outer-side protrusion 12 is formed to protrude toward the internal inner housing accommodating space 10. When the fitted state of the inner housing 3 with respect to the outer housing 2 is a completely fitted state, the outer-side protrusions 12 lock locking arms 33 of the inner housing 3 and hold the inner housing 3 in the inner housing accommodating space 10. In the completely fitted state in which the inner housing 3 is completely fitted to the outer housing 2, the outer-side protrusions 12 restricts the inner housing 3 from moving in the removal direction from the outer housing 2.

The pair of mounting holes 13 are provided on the inner surface of the outer housing 2. The pair of mounting holes 13 are formed on the inner surface of the outer housing 2 so as to face each other in the first direction. The mounting hole 13 is formed in the outer-side protrusion 12 provided on the inner surface of the outer housing 2. The mounting hole 13 penetrates the outer-side protrusion 12 in the insertion/removal direction. A part of a detection member 5 to be described below is inserted from the insertion direction, and the mounting hole 13 locks the detection member 5. The mounting hole 13 restricts the detection member 5 from being separated in the removal direction by locking the detection member 5.

The inner housing 3 is inserted into the inner housing accommodating space 10 of the outer housing 2 from the back surface 100*b* side of the wall part 100 via the through hole 101, and is fitted in the insertion direction. The inner housing 3 is locked to the outer housing 2 by a locking mechanism 6. The locking mechanism 6 restricts the movement of the inner housing 3 with respect to the outer housing 2 in the removal direction when the fitted state of the inner housing 3 with respect to the outer housing 2 is the completely fitted state.

The inner housing 3 is inserted from one of the openings of the outer housing 2 and is accommodated in the inner housing accommodating space 10 in the outer housing 2. The inner housing 3 has a tubular shape in which both ends in the insertion/removal direction are opened, and accommodates and holds terminals WT with electric wires from the opening on the removal direction side. The terminal WT with an electric wire is, for example, a metal terminal to which an electric wire W is connected. A terminal accommodated and held by the the inner housing 3 is, for example, a male terminal. Note that the terminal WT with an electric wire is indicated by a two dot chain line in FIG. 1 and FIG. 2, but is omitted in FIG. 3 and FIG. 4. The inner housing 3 is molded by, for example, an insulating synthetic resin. The sectional shape of the inner housing 3 in a section orthogonal to the insertion/removal direction is a rectangle with four corners rounded in an arc shape. The inner housing 3 has a plurality of terminal accommodating chambers 31, a plurality of openings 32, and the locking arms 33. Note that the inner housing 3 is specifically composed of two components (see FIG. 8).

Each terminal accommodating chamber 31 is a part that accommodates and holds the terminal WT with an electric wire. The terminal accommodating chamber 31 is what is called a cavity and penetrates along the insertion/removal direction of the inner housing 3. The terminal accommodating chamber 31 extends inside the inner housing 3 along the insertion/removal direction and is formed in a hollow shape. The terminal WT with an electric wire is inserted into the terminal accommodating chamber 31 along the insertion direction. The terminal accommodating chamber 31 is formed as a space having a size and a shape, which allow the insertion of the terminal WT, according to the outer shape of the terminal WT with an electric wire, and holds the terminal WT with an electric wire therein.

Each opening 32 is a part that communicates the terminal accommodating chamber 31 with an exterior and allows the insertion of the terminal WT with an electric wire. The openings 32 are arranged in the first direction and the second direction of the inner housing 3, respectively. Each opening 32 is an opening formed at a removal direction side-end of the terminal accommodating chamber 31.

The locking arm 33 is what is called a flexible lock arm. The locking arm 33 is provided on a pair of outer wall surfaces 30, which extend along the second direction and face outward the first direction, among outer wall surfaces 30 of the inner housing 3. The locking arm 33 extends along the removal direction of the inner housing 3. The locking arm 33 is locked to the outer-side protrusion 12 (see FIG. 3) when the inner housing 3 is inserted into the outer housing 2 and is completely fitted thereto. When the inner housing 3 is completely fitted to the outer housing 2, the locking arm 33 is locked to the outer-side protrusion 12. The locking arm 33 is formed to protrude from an outer peripheral surface of the inner housing 3, and when the fitted state of the inner housing 3 with respect to the outer housing 2 is the completely fitted state, the locking arm 33 gets over the outer-side protrusion 12, is located on the insertion direction side from the outer-side protrusion 12, and is locked to the outer-side protrusion 12 while facing the outer-side protrusion 12 in the removal direction opposite to the insertion direction.

Figure 5:
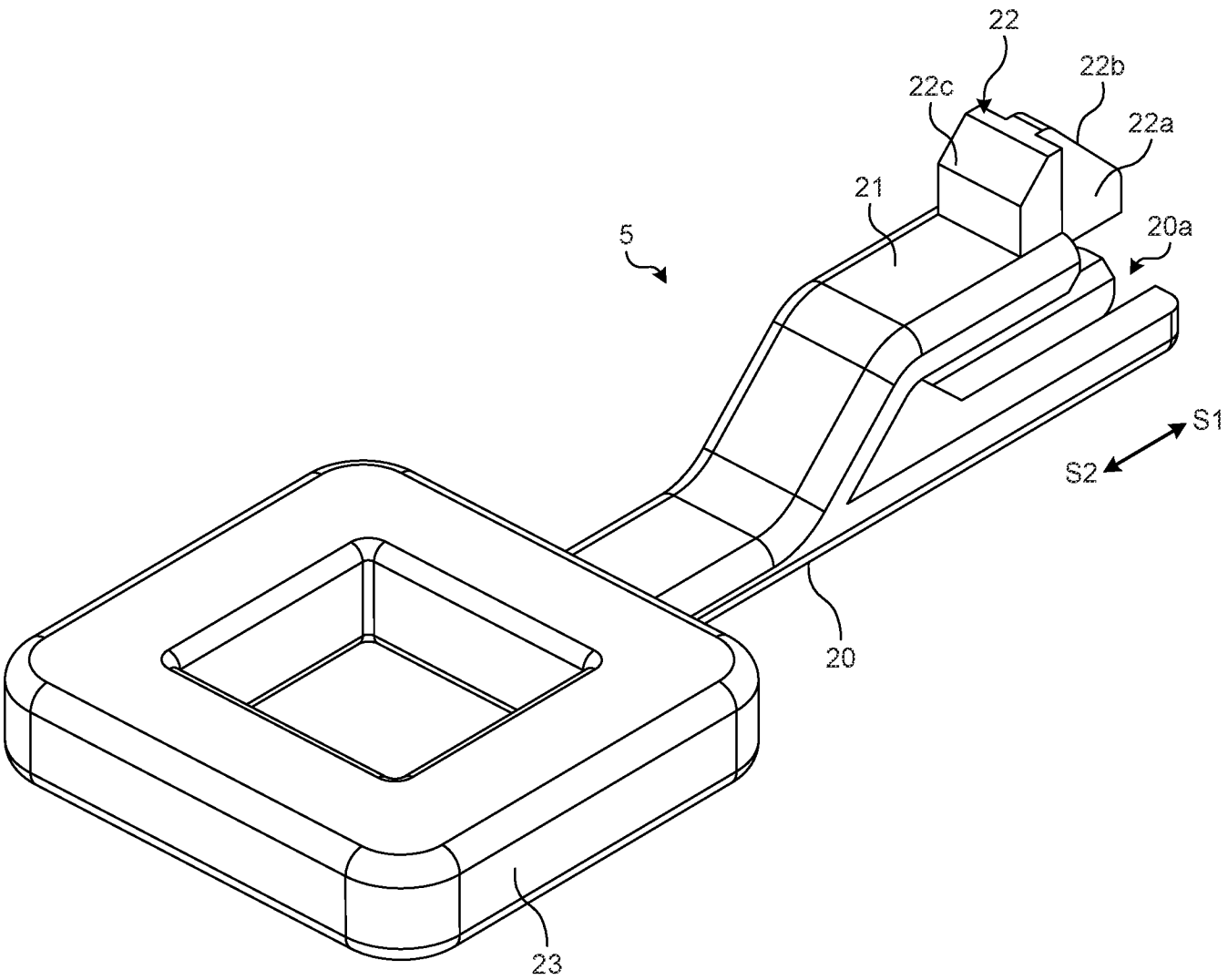
FIG. 5 is a perspective view of the detection member in the embodiment.
Figure 6:
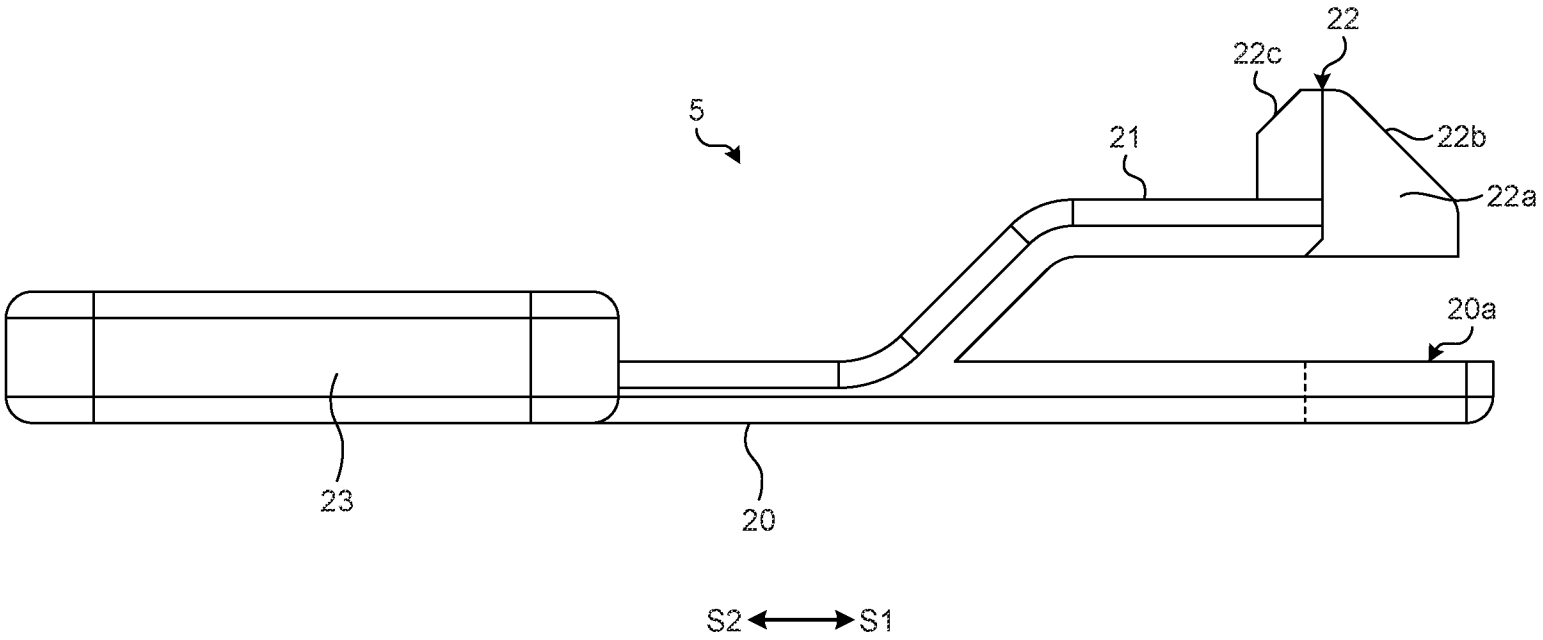
FIG. 6 is a side view of the detection member in the embodiment.

The detection member 5 is formed to engage with the mounting hole 13 of the outer housing 2, and protrude in the removal direction from the removal direction-side end of the outer housing 2 in an engaged state in which the detection member 5 has been engaged with the outer housing 2. In an assembled state in which the detection member 5 has been assembled to the outer housing 2, the detection member 5 is restricted from being separated from the outer housing 2 in the removal direction. When the fitted state of the inner housing 3 with respect to the outer housing 2 is the completely fitted state, the detection member 5 is allowed to be separated from the outer housing 2 in the removal direction. The detection member 5 is molded by an insulating synthetic resin. As illustrated in FIG. 5 and FIG. 6, the detection member 5 has a base 20, a lock arm 21, a member-side protrusion 22, and a grip part 23. Here, it is assumed that an S1 direction illustrated in FIG. 5 and FIG. 6 is the insertion direction of the detection member 5 into the outer housing 2, an S2 direction is a direction opposite to the S1 direction and is the removal direction (separation direction) of the detection member 5 from the outer housing 2.

The base 20 is a part that is detachable from the outer housing 2 in the insertion/removal direction. The base 20 is formed to extend in the insertion/removal direction in the assembled state in which the detection member 5 has been assembled to the outer housing 2, and at least a part thereof is inserted into the mounting hole 13. The base 20 has a slit 20*a*. The slit 20*a* is provided at the end of the base 20 on the insertion direction side. The slit 20*a* extends in the insertion direction and is formed to penetrate in a facing direction in which the base 20 and the lock arm 21 face each other. The slit 20*a* is a part where the insertion direction-side end of the lock arm 21 is inserted without abutting the base 20 when the lock arm 21 is bent toward the base 20 in the completely fitted state.

The lock arm 21 is a part that has flexibility, protrudes from the base 20, and extends in the extension direction. The lock arm 21 branches in the insertion direction from the vicinity of the center in the extension direction of the base 20, and extends in the extension direction of the base 20. The lock arm 21 has elasticity and flexibility, is elastically deformed in the facing direction with the branch point with the base 20 as a support point in response to pressure from the outside in the facing direction in which the base 20 and the lock arm 21 face each other, and elastically returns when the pressure is removed. The lock arm 21 has a member-side protrusion 22 at an end in the insertion direction from the branch point with the base 20.

The member-side protrusion 22 is a part formed on a free end side of the lock arm 21 and formed to protrude outward in the facing direction of the base 20. The member-side protrusion 22 faces the outer-side protrusion 12 in the removal direction in the assembled state. The member-side protrusion 22 has a slit insertion part 22*a*, an insertion direction-side guide surface 22*b*, and a removal direction-side guide surface 22*c*.

The slit insertion part 22*a* is a part that is inserted into the slit 20*a* of the base 20 when the lock arm 21 is bent toward the base 20. A width of the slit insertion part 22*a* in a direction orthogonal to the extension direction and the facing direction is formed to be narrower than that of the member-side protrusion 22 in accordance with the width of the slit 20*a*.

The insertion direction-side guide surface 22*b* is an inclined surface which is a distal end of the lock arm 21 and is formed on the insertion direction (S1 direction) side of the member-side protrusion 22. The insertion direction-side guide surface 22*b* forms a guide surface for contacting a removal direction-side opening end of the mounting hole 13 and guiding the distal end of the lock arm 21 along the insertion direction when the detection member 5 is assembled to the outer housing 2.

The removal direction-side guide surface 22*c* is an inclined surface formed at a position facing the insertion direction-side guide surface 22*b* in the removal direction. The removal direction-side guide surface 22*c* forms a guide surface for contacting an insertion direction-side opening end of the mounting hole 13 and guiding the distal end of the lock arm 21 along the removal direction when the detection member 5 is separated from the outer housing 2 in the removal direction.

The grip part 23 is a part that is connected to an end of the base 20, which is opposite to the slit 20*a*, in the extension direction and is formed in a rectangular ring shape. The grip part 23 is a part that protrudes in the removal direction from the removal direction-side end of the outer housing 2 in the assembled state. Preferably, the grip part 23 has a size and a shape that can be easily gripped by an operator with his/her fingertips when the detection member 5 is assembled to the outer housing 2 and when the detection member 5 is separated from the outer housing 2. Furthermore, the grip part 23 may have a size and a shape that allow the operator to assemble the detection member 5 to the outer housing 2 or to separate the detection member 5 from the outer housing 2 by using a jig and the like, for example.

Determination of the assembled and fitted states of the connector 1 of the present embodiment will be described with reference to FIG. 7 to FIG. 11. Note that one dot chain line C in FIG. 8 to FIG. 11 indicates a removal direction-side end surface of the outer housing 2.

Figure 7:
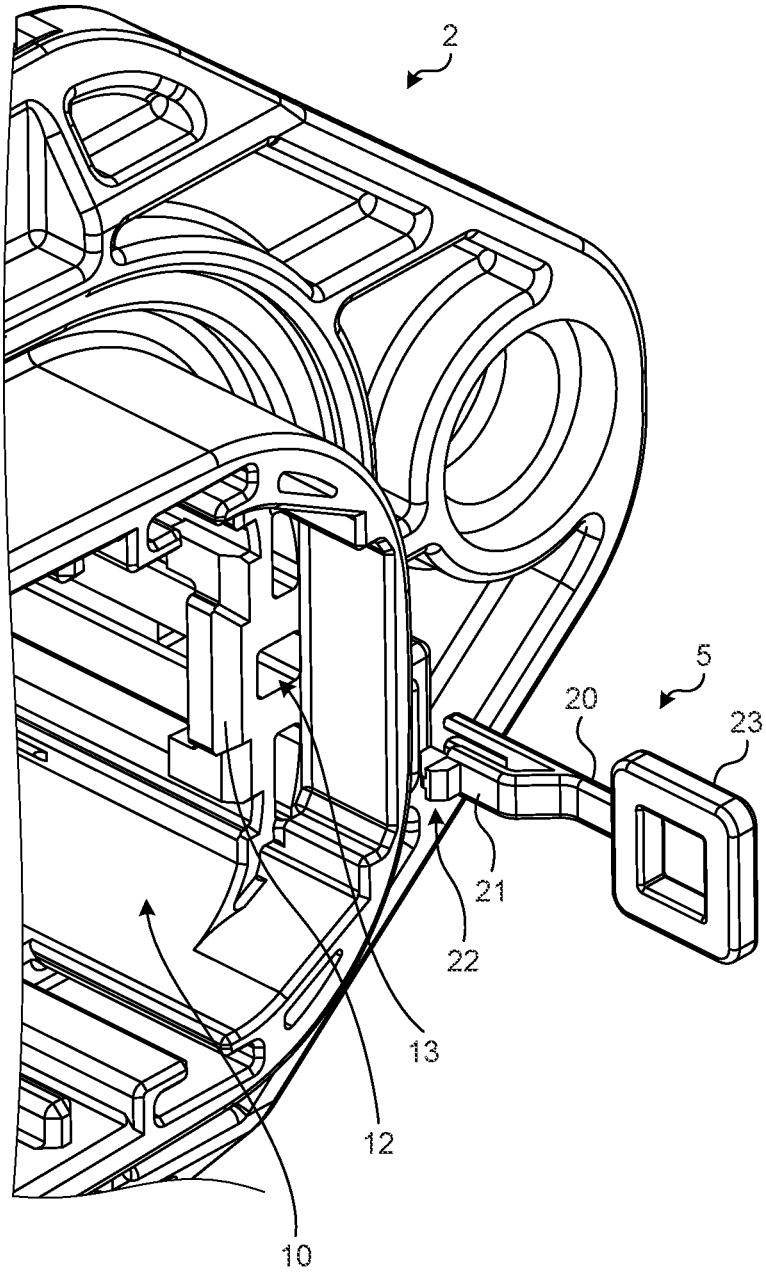
FIG. 7 is a perspective view illustrating the detection member before being engaged with the outer housing.
Figure 8:
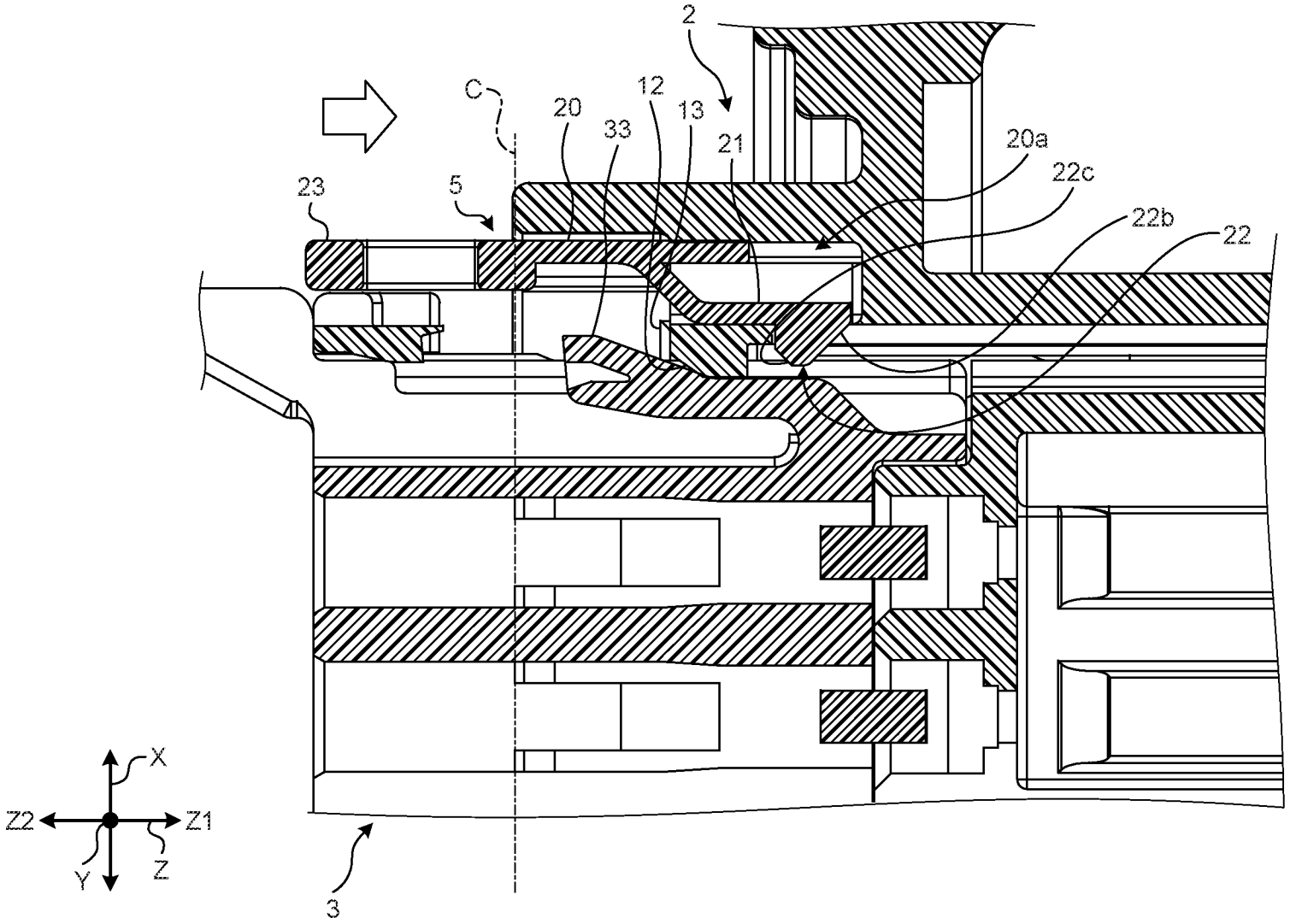
FIG. 8 is a sectional view illustrating the detection member engaged with the outer housing.

First, as illustrated in FIG. 7, the operator assembles the detection member 5 to the outer housing 2. The operator grips the grip part 23 of the detection member 5 with his/her fingertips and inserts the detection member 5 into the mounting hole 13 of the outer housing 2 from the insertion direction side. At this time, the insertion direction-side guide surface 22*b* of the member-side protrusion 22 comes into contact with the removal direction-side opening end of the mounting hole 13, and the lock arm 21 is pressed toward the base 20 and is guided into the mounting hole 13 while being elastically deformed. Then, when the member-side protrusion 22 of the lock arm 21 comes out of the insertion direction-side opening end of the mounting hole 13, the elastically deformed lock arm 21 elastically returns, so that the outer-side protrusion 12 faces the member-side protrusion 22 in the removal direction and thus the detection member 5 is locked to the outer housing 2.

Next, the operator attaches the outer housing 2 to the wall part 100. The outer housing 2 is attached with a seal member and a holder. The operator inserts a part of the outer housing 2 into the through hole 101 of the wall part 100 and fixes the outer housing 2 to the wall part 100 with the bolts 102. The bolts 102 are inserted into the through holes of the outer housing 2 and screwed into screw holes of the wall part 100. The flange portion 11 of the outer housing 2 is fastened to the wall part 100 by two bolts 102.

Figure 9:
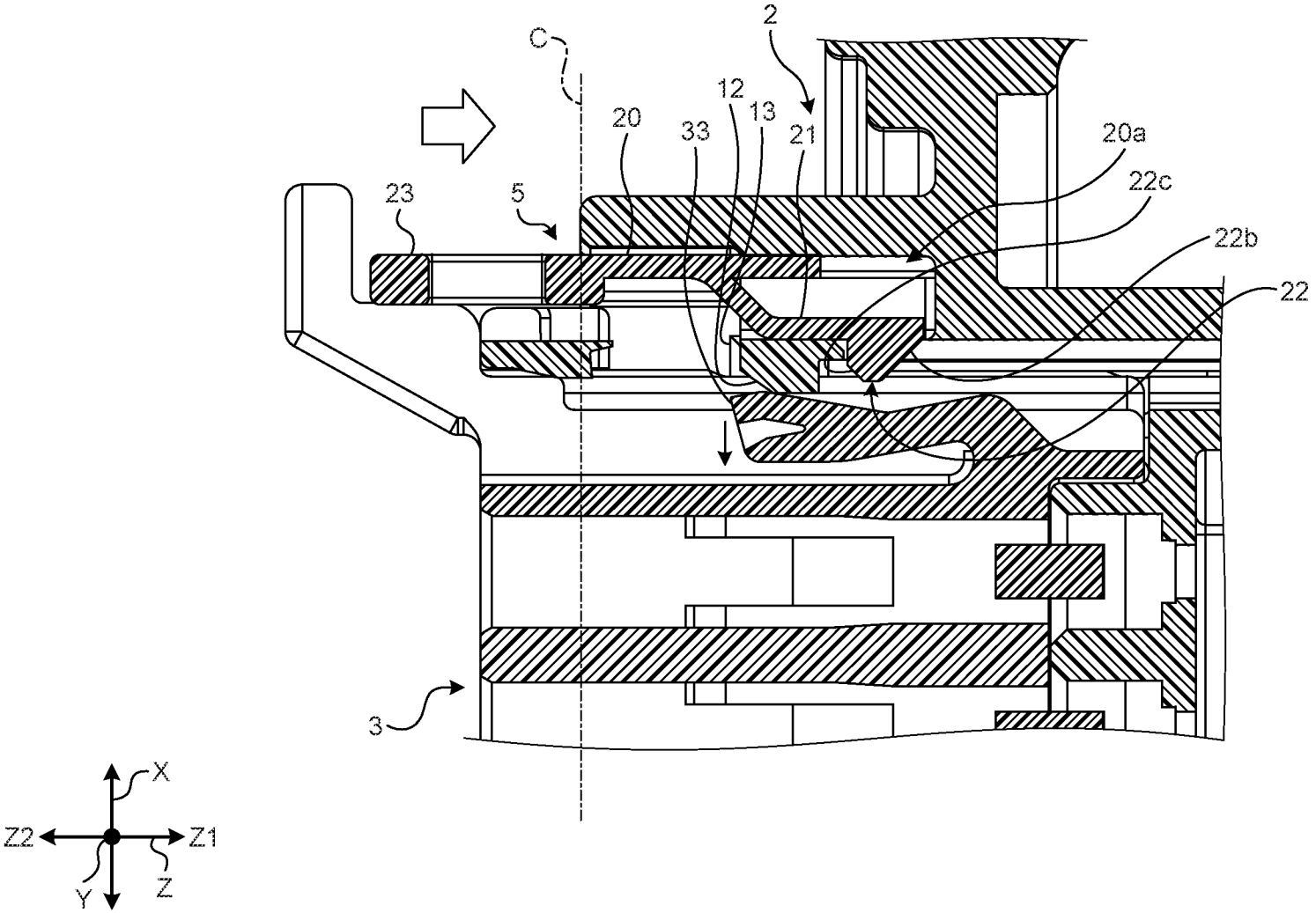
FIG. 9 is a sectional view illustrating the detection member in a process in which the inner housing is fitted to the outer housing.
Figure 10:
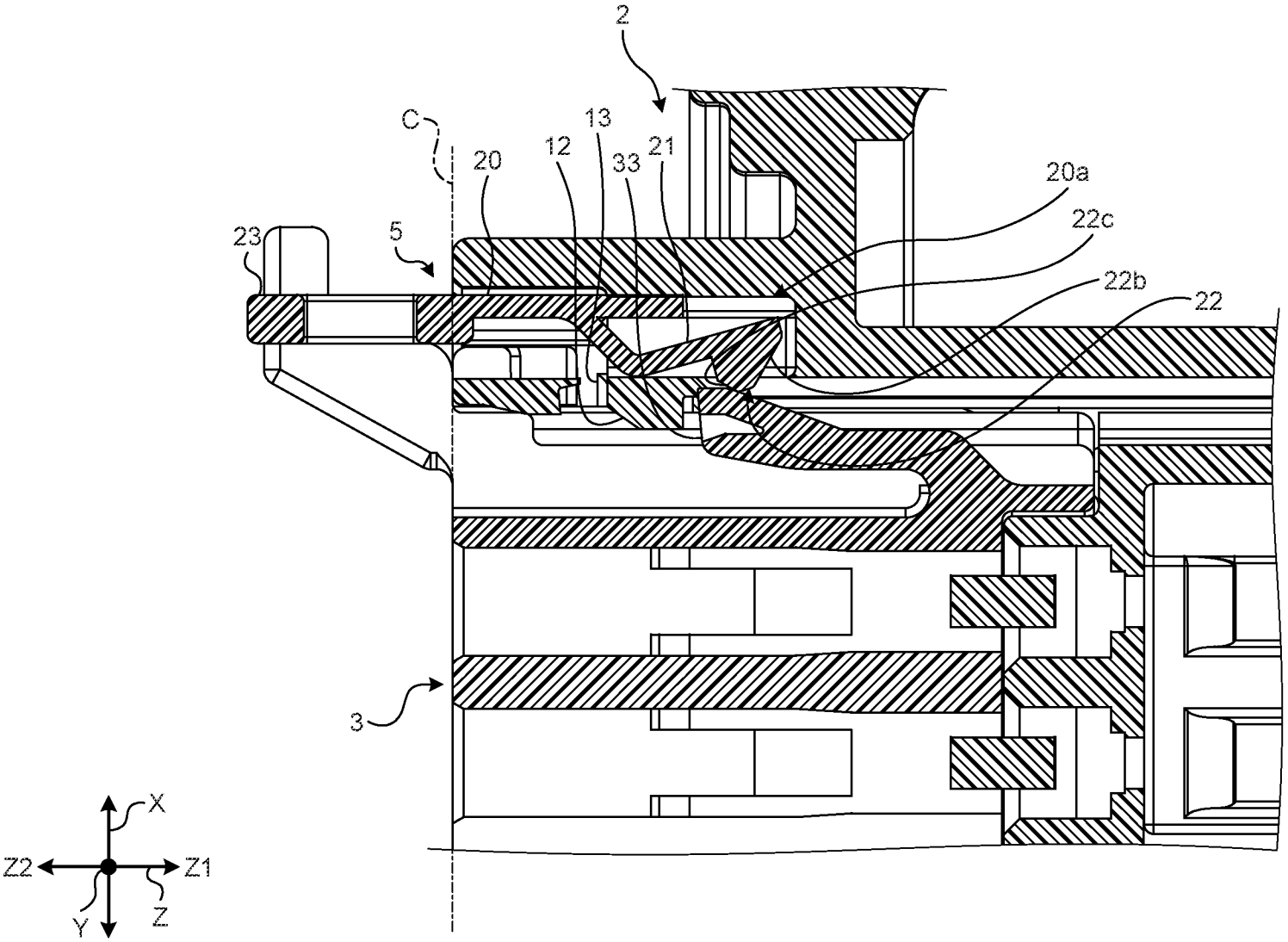
FIG. 10 is a sectional view illustrating the detection member after the inner housing is fitted to the outer housing.

Next, the operator inserts the inner housing 3 into the outer housing 2 and fits the inner housing 3 to the outer housing 2. The inner housing 3 is inserted into the outer housing 2 from the back surface 100*b* side of the wall part 100 via the through hole 101. When the inner housing 3 moves in the insertion direction (FIG. 8), the locking arm 33 comes into contact with the outer-side protrusion 12 and is elastically deformed inward the inner housing accommodating space 10 (FIG. 9). The locking arm 33 elastically returns after getting over the outer-side protrusion 12, faces the outer-side protrusion 12 in the removal direction, and is locked to the outer-side protrusion 12 (FIG. 10). At this time, the fitted state of the inner housing 3 with respect to the outer housing 2 is the completely fitted state. In the completely fitted state, the removal direction-side end surface of the outer housing 2 and the removal direction-side end surface of the inner housing 3 are flush with each other on the one dot chain line C.

Furthermore, the locking arm 33 elastically returns after getting over the outer-side protrusion 12, and presses the member-side protrusion 22 of the lock arm 21 outward the inner housing accommodating space 10 (FIG. 10). The lock arm 21 is elastically deformed outward the inner housing accommodating space 10 by the pressing of the locking arm 33 against the member-side protrusion 22, the outer-side protrusion 12 and the member-side protrusion 22 are in a non-facing state in the insertion/removal direction, thereby allowing the detection member 5 to be separated in the removal direction.

Figure 11:
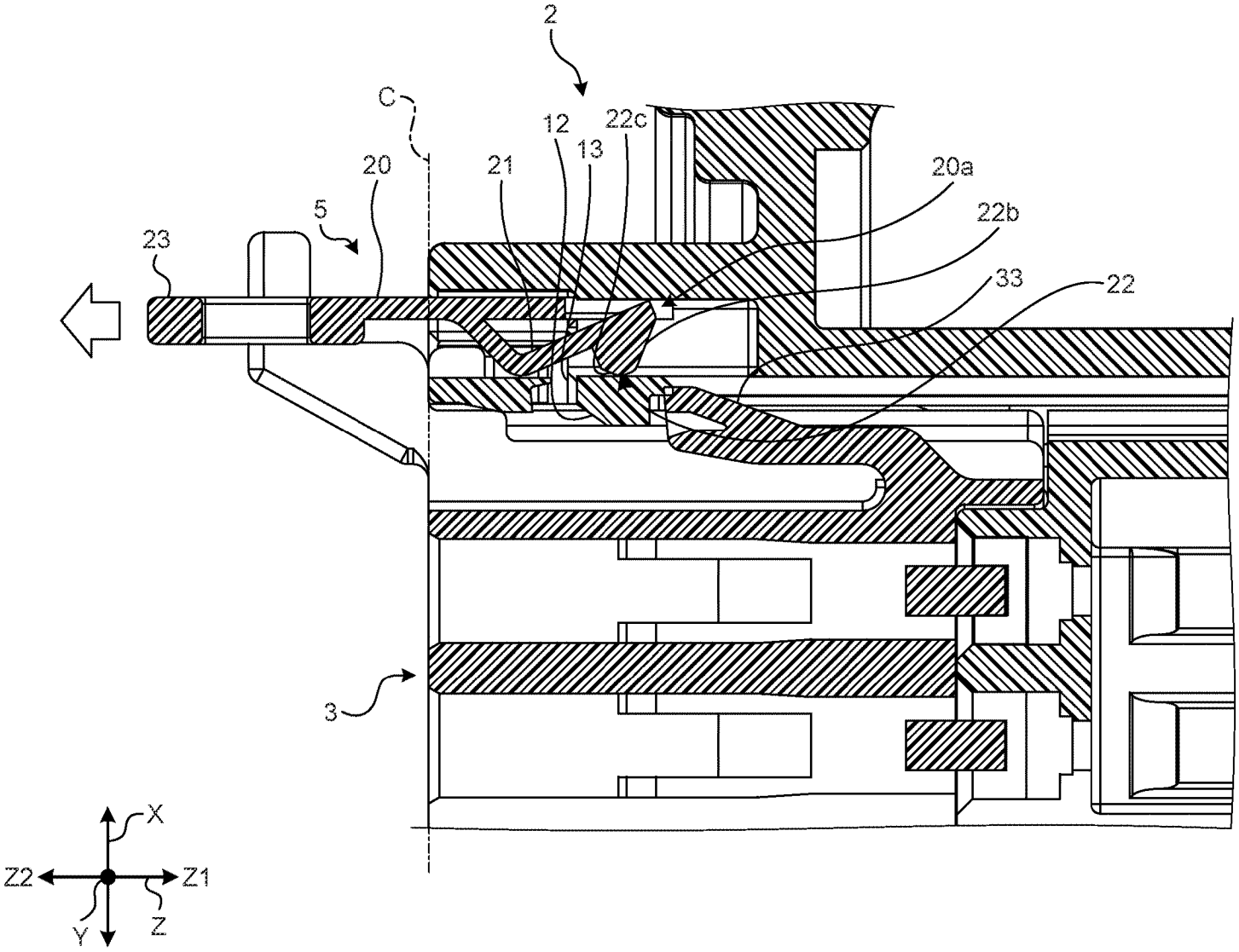
FIG. 11 is a sectional view illustrating the detection member that is released from an engagement position with the outer housing.

When the fitted state of the inner housing 3 with respect to the outer housing 2 is the completely fitted state, since the outer-side protrusion 12 and the member-side protrusion 22 are in the non-facing state in the insertion/removal direction as illustrated in FIG. 11, the detection member 5 can be pulled out from the outer housing 2. The operator pulls out the detection member 5 to the removal direction side while gripping the grip part 23 of the detection member 5 with his/her fingertips. At this time, the removal direction-side guide surface 22*c* of the member-side protrusion 22 comes into contact with the insertion direction-side opening end of the mounting hole 13, and the lock arm 21 is pressed toward the base 20 and is guided into the mounting hole 13 while being elastically deformed. Then, the member-side protrusion 22 of the lock arm 21 comes out of the removal direction-side opening end of the mounting hole 13, so that the elastically deformed lock arm 21 elastically returns. With this, it is possible to easily determine whether the outer housing 2 and the inner housing 3 have been completely fitted.

The facing state between the outer-side protrusion 12 and the member-side protrusion 22 is maintained until the locking arm 33 gets over the outer-side protrusion 12. The position of the outer-side protrusion 12 is maintained so that the outer-side protrusion 12 is not elastically deformed or bent even though the outer-side protrusion 12 is pressed by the locking arm 33 with the movement of the inner housing 3. With this, when the fitted state of the inner housing 3 with respect to the outer housing 2 is a semi-fitted state, it is possible to maintain the facing state between the outer-side protrusion 12 and the member-side protrusion 22 in the insertion/removal direction, to restrict the separation of the detection member 5 in the removal direction, and to accurately detect the completely fitted state. At the timing when the locking arm 33 faces the outer-side protrusion 12 in the removal direction, the member-side protrusion 22 of the lock arm 21 is pressed outward the inner housing accommodating space 10, so that the outer-side protrusion 12 and the member-side protrusion 22 are not able to maintain the facing state in the insertion/removal direction and thus transition to a non-facing state. Since the outer-side protrusion 12 and the member-side protrusion 22 are in the non-facing state in the insertion/removal direction, the detection member 5 can be separated in the removal direction.

As described above, the connector 1 of the present embodiment includes the outer housing 2, the inner housing 3 that is completely fitted to the outer housing 2 while being accommodated in the inner housing accommodating space 10 of the outer housing 2, and the detection member 5 that is assembled to the outer housing 2 and is restricted from being separated in the removal direction. The detection member 5 has the flexible lock arm 21 extending in the insertion/removal direction and the member-side protrusion 22 formed on the free end side of the lock arm 21 and facing the outer-side protrusion 12 in the removal direction in the assembled state. When the locking arm 33 gets over the outer-side protrusion 12 and is locked to the outer-side protrusion 12, the locking arm 33 moves in the insertion direction while being elastically deformed, and elastically returns after getting over the outer-side protrusion 12 to press the member-side protrusion 22 outward the inner housing accommodating space 10, so that the lock arm 21 allows the outer-side protrusion 12 and the member-side protrusion 22 to be in the non-facing state in the insertion/removal direction, and allows the detection member 5 to be separated in the removal direction.

With the above configuration, when the fitted state of the inner housing 3 with respect to the outer housing 2 is not the completely fitted state, for example, the operator is not able to easily pull out the detection member 5 in the removal direction (separation direction). However, when the fitted state is the completely fitted state, since the detection member 5 can be easily pulled out, the operator can easily determine whether the outer housing 2 and the inner housing 3 have been completely fitted. Furthermore, when the fitted state of the inner housing 3 with respect to the outer housing 2 is the semi-fitted state, the reliability of electrical connection may be reduced in a fitted state between the connector 1 and a mating connector. Therefore, by accurately determining the fitted state between the outer housing 2 and the inner housing 3, it is possible to improve the reliability of the electrical connection in the fitted state between the connector 1 and the mating connector.

Furthermore, in the connector 1 of the present embodiment, when the outer housing 2 is viewed from the removal direction, the outer housing 2 has the pair of short side portions 2*b* that face each other in the first direction orthogonal to the insertion/removal direction and extend in the second direction orthogonal to the insertion/removal direction and the first direction. Each short side portion 2*b* is provided with one outer-side protrusion 12. The inner housing 3 is provided with the locking arm 33 at a position corresponding to each of the outer-side protrusions 12. The detection member 5 is assembled at the position corresponding to each of the outer-side protrusions 12 on the respective short side portions 2*b*. Since the long side portion 2*a* is longer than the short side portion 2*b* and the locking mechanisms 6 are provided at both ends in the first direction (longitudinal direction), one of both ends in the first direction (longitudinal direction) may be first engaged when the inner housing 3 is fitted to the outer housing 2. That is, even though one of both ends is in the engaged state, the other of both ends may be in a disengaged state. Since all the locking mechanisms 6 need to be in the engaged state in order for the inner housing 3 to be in the completely fitted state with respect to the outer housing 2, the detection member 5 is provided corresponding to each locking mechanism 6. With this, it is possible to accurately perform determination regarding whether the outer housing 2 and the inner housing 3 have been completely fitted.

Note that, in the aforementioned embodiment, the grip part 23 is formed in a rectangular ring shape, but the grip part 23 may have any shape as long as the operator can grip or hook the grip part 23 by using his/her fingertips, a jig, and the like, for example.

The connector according to the present embodiment has an effect that it is possible to easily determine whether an outer housing and an inner housing have been completely fitted.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a tubular outer housing having an outer-side protrusion formed to protrude toward an internal inner housing accommodating space;

an inner housing inserted from one opening of the outer housing and accommodated in the inner housing accommodating space, the inner housing having a locking arm that is formed to protrude from an outer peripheral surface of the inner housing, with a fitted state of the inner housing with respect to the outer housing being a completely fitted state, the locking arm getting over the outer-side protrusion, being located on a side of an insertion direction from the outer-side protrusion, and being locked to the outer-side protrusion while facing the outer-side protrusion in a removal direction opposite to the insertion direction; and a detection member that is restricted from being separated from the outer housing in the removal direction opposite to the insertion direction in an assembled state in which the detection member is assembled to the outer housing, wherein the detection member includes:

a base that is detachable from the outer housing in an insertion/removal direction;

a flexible lock arm that protrudes from the base and extends in the insertion/removal direction; and a member-side protrusion formed on a free end side of the lock arm and facing the outer-side protrusion in the removal direction in the assembled state, and when the locking arm gets over the outer-side protrusion and is locked to the outer-side protrusion, the locking arm moves in the insertion direction while being elastically deformed, and elastically returns after getting over the outer-side protrusion to press the member-side protrusion outward the inner housing accommodating space, so that the lock arm allows the outer-side protrusion and the member-side protrusion to be in a non-facing state in the insertion/removal direction, and allows the detection member to be separated in the removal direction.

2. The connector according to claim 1, wherein when the outer housing is viewed from the removal direction, the outer housing has a pair of side portions that face each other in a first direction orthogonal to the insertion/removal direction and extend in a second direction orthogonal to the insertion/removal direction and the first direction, each of the side portions is provided with at least one outer-side protrusion, the locking arm is provided at a position where the locking arm is locked to each of the outer-side protrusions in the completely fitted state, and the detection member is assembled at a position corresponding to each of the outer-side protrusions on the respective side portions in the assembled state.

3. The connector according to claim 1, wherein a part of the outer housing on a side of the removal direction is inserted into a through hole, penetrating from a front surface to a back surface of a wall part in a casing, from a side of the front surface, so that the outer housing is fixed to the front surface, and the inner housing is inserted into the outer housing from a side of the back surface of the wall part via the through hole and is fitted in the insertion direction.

4. The connector according to claim 2, wherein a part of the outer housing on a side of the removal direction is inserted into a through hole, penetrating from a front surface to a back surface of a wall part in a casing, from a side of the front surface, so that the outer housing is fixed to the front surface, and the inner housing is inserted into the outer housing from a side of the back surface of the wall part via the through hole and is fitted in the insertion direction.

* * * * *